US006252561B1

(12) United States Patent
Wu et al.

(10) Patent No.: US 6,252,561 B1
(45) Date of Patent: Jun. 26, 2001

(54) WIRELESS LAN ANTENNA WITH SINGLE LOOP

(75) Inventors: Ming-Hsiu Wu; Kun-Fang Wu, both of Taipei; Wen-Hsiung Lin; Ji-Hong Hsiao, both of Taipei Hsien, all of (TW)

(73) Assignee: Accton Technology Corporation, Hsinchu (TW)

( * ) Notice: Subject to any disclaimer, the term of this patent is extended or adjusted under 35 U.S.C. 154(b) by 0 days.

(21) Appl. No.: 09/365,974

(22) Filed: Aug. 2, 1999

(51) Int. Cl.[7] ..... H01Q 7/00
(52) U.S. Cl. ..... 343/866; 343/741
(58) Field of Search ..... 343/702, 866, 343/700 MS, 846, 848, 718, 752, 741, 895, 859, 872, 894, 713, 727, 853

(56) References Cited

U.S. PATENT DOCUMENTS 4,758,843 7/1988 Agrawal et al. .
5,206,657 4/1993 Downey .
5,495,260 2/1996 Couture .
5,847,682 * 12/1998 Ke ..... 343/752
5,886,669 * 3/1999 Kita ..... 343/718
6,054,952 * 4/2000 Shen et al. ..... 343/700 MS

* cited by examiner

*Primary Examiner*—Don Wong
*Assistant Examiner*—Chuc D Tran
(74) *Attorney, Agent, or Firm*—Rosenberg, Klein & Lee

(57) ABSTRACT

A wireless LAN antenna comprises a dielectric substrate having a first surface and a second surface. The first surface of the dielectric substrate has a rectangular loop. A rectangular grounding copper foil is adhered within the rectangular loop. A signal feeding copper foil is further included. One end of the signal feeding copper foil is connected to the rectangular loop and the grounding copper foil, while another end of the signal feeding copper foil running across another end of the rectangular loop. Moreover, a layer of back surface copper foil is plated to the back side of the printed circuit board. This back surface copper foil covers one half of the loop on the front surface. Adjustment of the transversal dimensions of the grounding copper foil will impedance-match the antenna to the feeding structure of the antenna.

7 Claims, 5 Drawing Sheets

Frequency. 2.46 (GHz)

Maximum at (172.5, 0) degrees
The Directivity: 2.71846 (dB)
Mismatch Loss: -0.198659 (dB)
Circular Polarization Loss: -2.62343 (dB)
Efficiency: 53.0708% (-2.75144 dB)
Total Radiated Power: 0.00506979 (W)
Average Radiated Power: 0.000403441 (W/s)
Input Power at Ports: 0.00955288 (W)

WIRELESS LAN ANTENNA WITH SINGLE LOOP

BACKGROUND OF THE INVENTION

1. Field of the Invention

This invention relates to a wireless LAN antenna with a single loop for use in radio communication and more particularly to a wireless LAN antenna printed on a dielectric board without needing to be impedance matched by outer components.

2. Description of the Prior Art

Nowadays, wireless communication is more and more popular, since a wireless device has the advantages of portability, so that a user need not be confined by his (or her) location. Thus, one can obtain information or communicate with others anywhere. The difference between wired and wireless communications is that a wireless device has a transmitting and receiving portion and further an antenna for performing wireless signal communication. In the conventional wireless device, the antenna is mainly a dipole which is formed by a metal rod or a helical cylinder, and is extended out from a wireless device. Because compactness has become a new trend for a wireless device, in recent years, the design of an antenna has been improved greatly. At first, the size of an antenna is minimized. However, the antenna has the drawbacks that the antenna itself has enlarged the size of the device. The antenna is extended out from the device and thus easy to pierce the body of the user. Further, it is easily broken. To overcome the drawbacks, a foldable antenna is invented. In general, this antenna can be hidden within the housing of the device. If it is used, the user draws the antenna from the housing. This has resolved some of the aforementioned problems, but it is inconvenient to the user. Therefore, recently, a novel design has been disclosed. The concept of patch antennas has been employed in the antenna design. This type of antenna is so-called "printed circuit antenna". Print circuit antennas have been utilized in the field of radio communications to provide a light weight antenna. U.S. Pat. No. 5,495,260 to couture is an example of a simple dipole antenna realized in the form of a print circuit antenna. U.S. Pat. No. 4,758,843 to Agrawal shows a planar printed circuit substrate having a plurality of dipole antennas and a feed network including a sum and difference hybrid printed circuit thereon. U.S. Pat. No. 5,206,657 to Downey shows a printed circuit radio frequency antenna comprising a pair of double sided printed circuit boards spaced apart by standoffs.

An antenna with high directivity has always been desired for its efficiency in direct point-to-point radio communication. It will be very useful in radio communication to have a printed circuit antenna with high directivity. In addition to its light weight, a planar printed circuit antenna has an advantage that it can be formed at the same time and on the same substrate with other circuit sections. The wireless transceiver system can use this feature to make an integrated system on a printed circuit board to reduce the manufacturing time and cost. The absence of mechanical structures or connectors in the antenna construction also improves the reliability of the wireless transceiver system.

Unfortunately, the existing printed circuit antennas in various configurations do not provide a simple solution for the high directivity antenna. There is a need to develop a printed circuit antenna which has a planar structure to be integrated with other electronic circuits, exhibits higher directivity than a single dipole antenna, and occupies relatively smaller area on the substrate.

SUMMARY OF THE INVENTION

Accordingly, the primary object of the present invention is to provide a wireless LAN antenna having piece bodies. The sizes of the piece bodies may serve to adjust the impedance matching between the antenna and the feeding structure, and more preferably, it is only necessary to adjust the transversal dimension thereof. Therefore, the original impedance matching elements in the feeding structure greatly.

Therefore, the present invention provides a wireless LAN antenna comprising a dielectric substrate having a first surface and a second surface. The first surface of the dielectric substrate has a rectangular loop. A rectangular grounding copper foil is adhered within the rectangular loop. A signal feeding copper foil is further included. One end of the signal feeding copper foil is connected to the rectangular loop and the grounding copper foil, while another end of the signal feeding copper foil running across another end of the rectangular loop. Moreover, a layer of back surface copper foil is plated to the back side of the printed circuit board. This back surface copper foil covers one half of the loop on the front surface. Adjustment of the transversal dimensions of the grounding copper foil will impedance-match the antenna to the feeding structure of the antenna.

DETAILED DESCRIPTION OF THE PREFERRED EMBODIMENT

The following detailed description is deemed to be the best presently contemplated modes of carrying out the invention. This description is not to be taken in a limiting sense, but is made merely for purpose of illustrating the general principle of the invention, since the scope of the invention is defined by the appended claims.

Figure 1A:
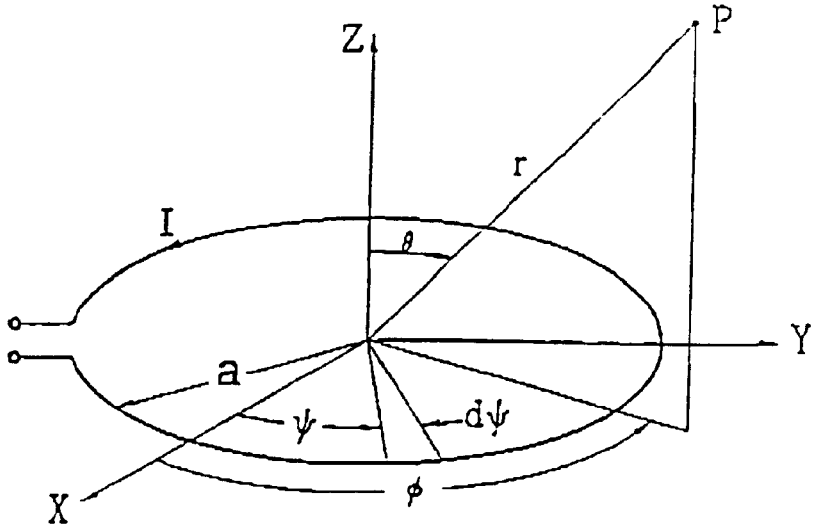
FIGS. 1A and 1B show the coordinate and radiating pattern of an antenna loop.

Referring to *Antennas* of John D. Kraus, 2nd edition, a single loop antenna with a radius a is shown in FIG. 1. The input current is I, and the dimension and coordinate are shown in FIG. 1A. From Maxwell theory, the radiation pattern of an antenna $A\phi$ may be derived from the following equation:

$$A\phi(\theta)=j2\ \pi IaJ1(ka\ \sin\ \theta)$$

where J1 is Bessel function of first order $$k=2\ \pi\lambda$$

Figure 1B:
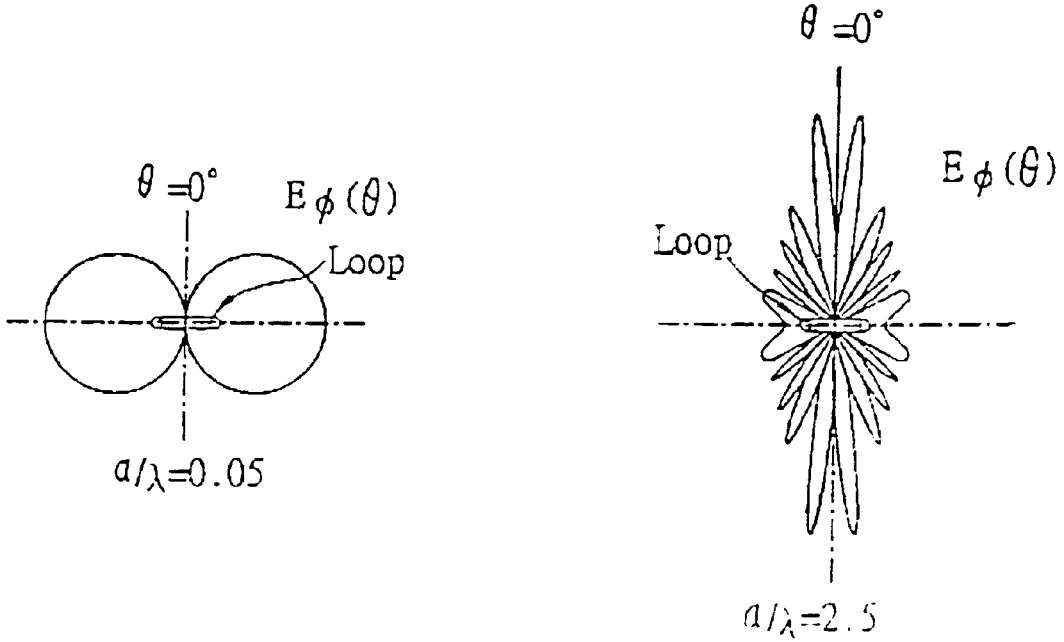

The pattern is shown in FIG. 1B. It is appreciated from FIG. 1 that a loop antenna is a directional antenna. In general, capacitor or inductors are added in the feeding portion of a loop antenna for impedance matching.

In order to conform with the trend of a printed circuit antenna, it is hoped that a loop antenna can be made as a printed circuit antenna so that it may be printed on the circuit board and thus has a compact size. Moreover, a directional antenna is thus achieved so as to enhance the transmitting and receiving ability. Further, it is hoped that the matching circuit of this loop antenna is also a printed circuit element which can be printed on the substrate with the original element and therefore, extra impedance elements, such inductors or capacitors are not necessary.

Figure 2:
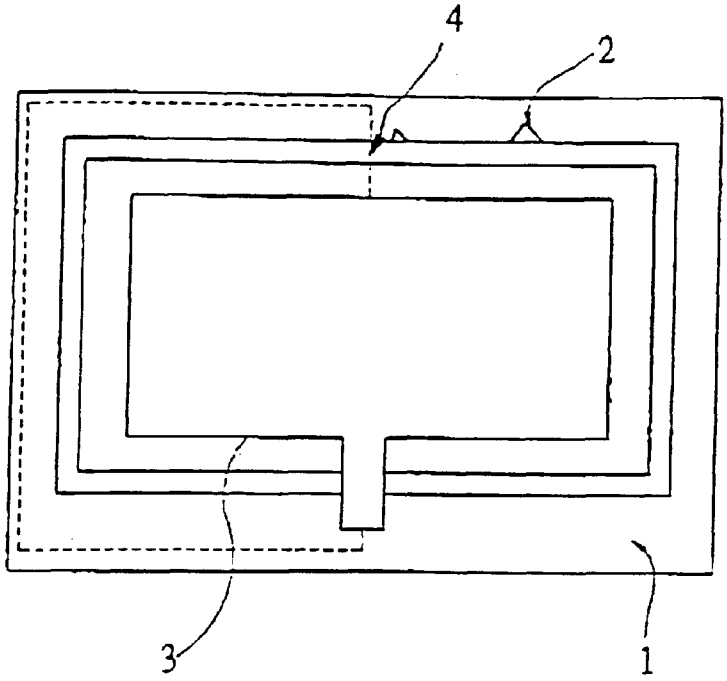
FIG. 2 is a front view of the wireless LAN antenna according to the present invention.
Figure 3:
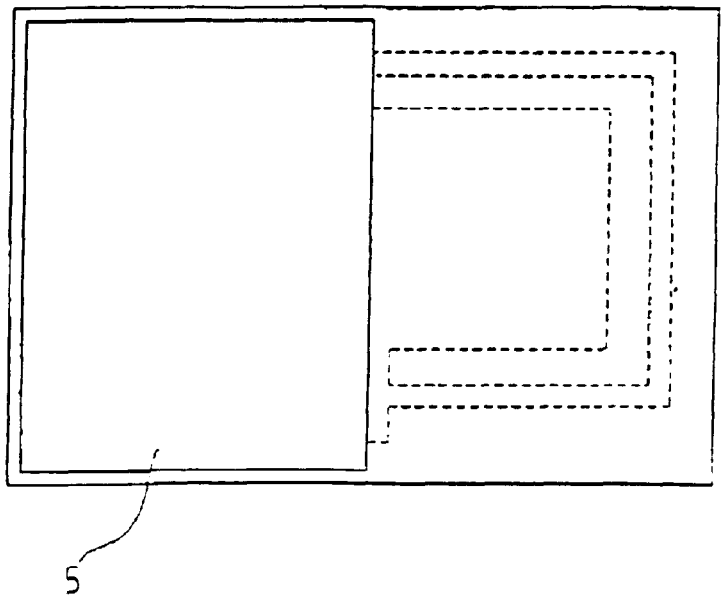
FIG. 3 is a rear view of the wireless LAN antenna according to the present invention.

In the present invention, the theory of a loop antenna is applied to a printed circuit antenna. As shown in FIG. 2, the front view of the present invention is illustrated. The antenna of the present invention includes a dielectric substrate 1 having a first surface and a second surface. The surface of the dielectric substrate 1 has a loop 2, a grounding copper foil 3, a signal feeding copper foil 4. As shown in FIG. 3, a layer of back surface copper foil 5.

Figure 4:
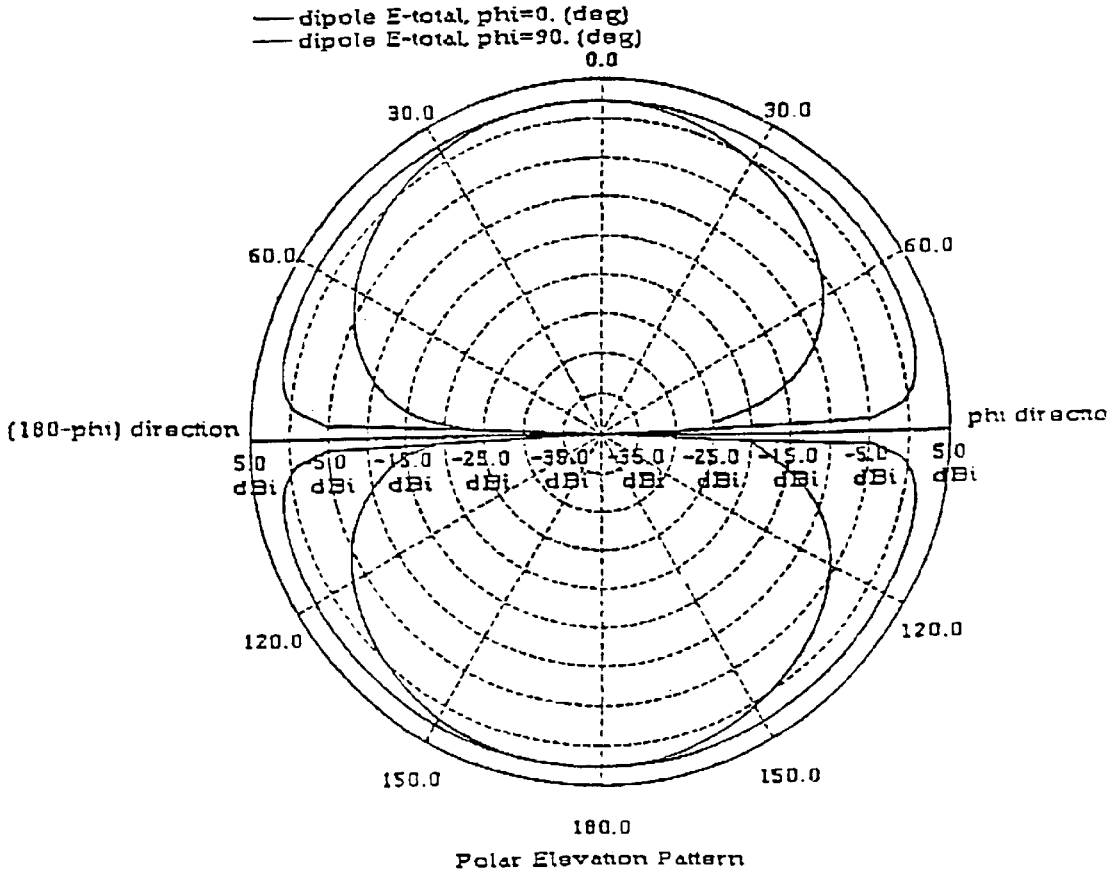
FIG. 4 shows the radiating pattern of the present invention from a computer simulation
Figure 5:
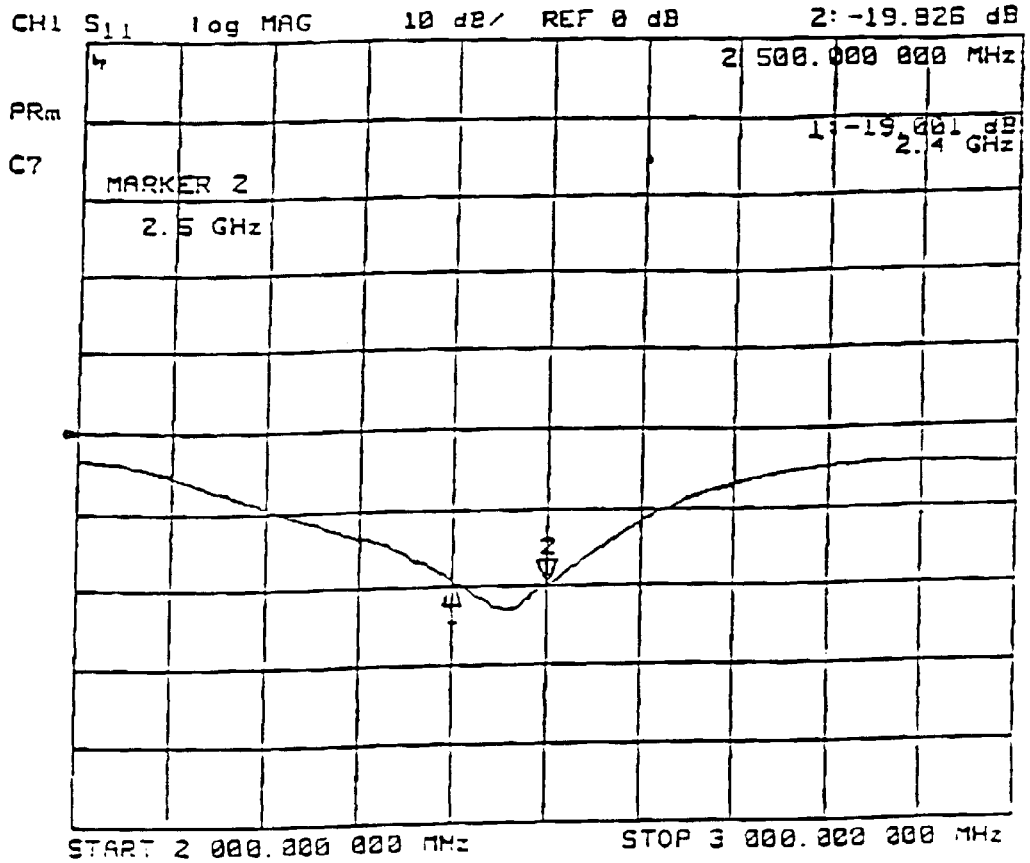
FIG. 5 shows the return loss of the present invention from experiment.
Figure 6:
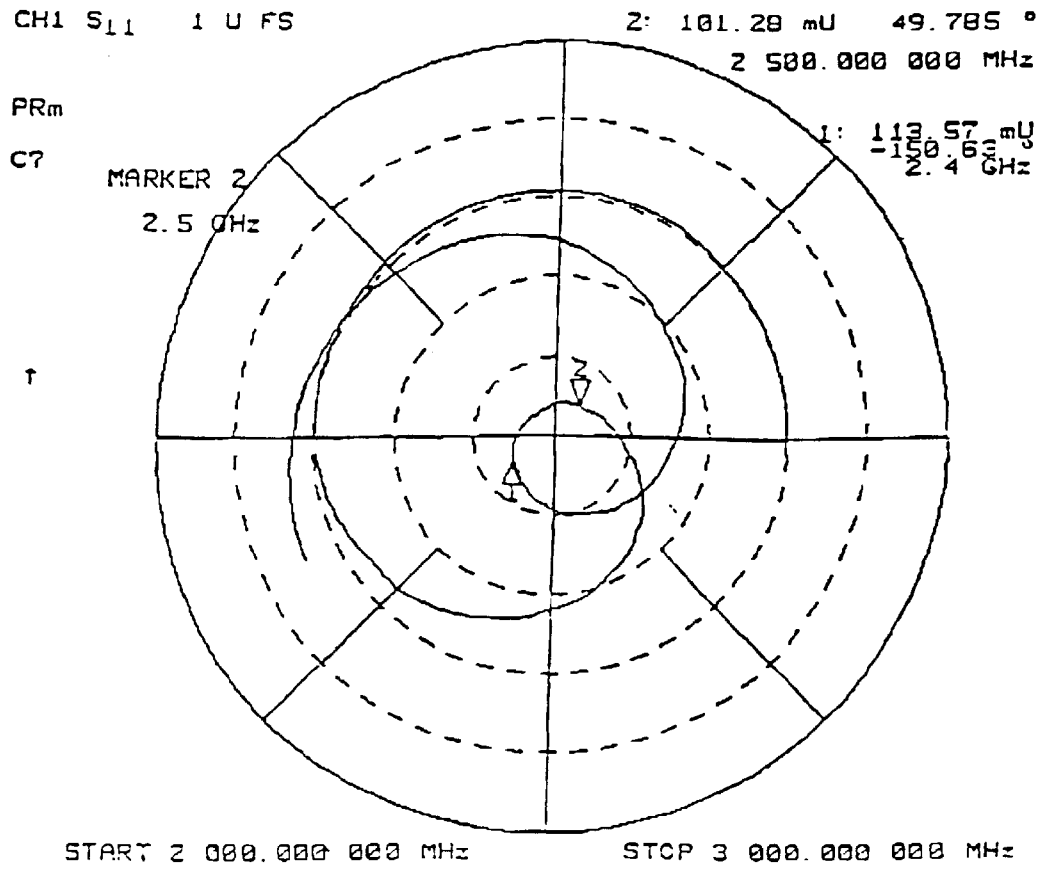
FIG. 6 shows the Smith chart from an experiment of the present invention.

At first, a rectangular loop 2 is laid out on the printed circuit board. Next, a rectangular grounding copper foil is adhered within the rectangular loop. Besides, one end of the signal feeding copper foil 4 is connected to the rectangular loop 2 and the grounding copper foil 3, while another end running across another end of the rectangular loop. In the present invention, a layer of back surface copper foil 5 is plated to the back side of the printed circuit board. As shown in FIG. 3, this back surface copper foil 5 covers one half of the loop on the front surface. The object for arranging this back surface copper foil 5 is to cause the current in the left side of the loop to have some phase difference from that in the right side thereof to enhance the radiating effect. It is appreciated from experiment and test, that the sizes of the grounding copper foil 3 may serve to adjust the impedance matching between the antenna and the feeding structure, and more preferably, it is only necessary to adjust the transversal dimension. Therefore, the original impedance matching elements in the feeding structure are not necessary. Consequently, the present invention may save more cost. However, the structure of the present invention is very complicated and it is very difficult to be analyzed theoretically. Therefore, in the present invention, experiment and computer simulation are performed to derive effect of this antenna. FIGS. 4~6 shows the results of the simulation and experiment. In this experiment, the size of the loop is 7.2 by 42.3 mm and the size of the grounding copper foil is 2.4 by 36 mm. The simulated radiating pattern of the present invention is shown in FIG. 4. It is appreciated that the antenna according to the present invention has a large directivity. The return loss of the present invention is shown in FIG. 5. It is known from the experiment that in 2.45 GHz, the return loss of the present invention may be as low as −21 dB. Therefore, in that frequency, the present invention has substantially a preferred effect. Alternatively, the bandwidth of the present invention has attain a value of 100 MHz, which is sufficiently wide in the practical use. FIG. 6 shows a Smith chart of an experiment, and the same result is presented therefrom.

In summary, the present invention has following advantages:

1. It is only necessary to adjust the gap between the loop and the grounding copper foil to vary the band and impedance.
2. Extra matching elements are unnecessary, and thus the cost is saved greatly.
3. A gain larger then 0 dB is obtained.
4. The cost of the printed circuit board is low.
5. The antenna according to the present invention has a compact size. Accordingly, the wireless LAN antenna of the present invention has not only practical effect but also a novel design.

Although the present invention has been described with reference to the preferred embodiments, it will be understood that the invention is not limited to the details described thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. An antenna comprising:

a dielectric substrate having a front surface side and a back surface side;

a rectangular closed-loop element laid out on said front surface side of said dielectric substrate;

a layer of rectangular grounding element formed on said front surface side of said dielectric substrate and circumscribed by said rectangular closed-loop element, said layer of rectangular grounding element having a vertical rectangular protrusion portion at the bottom center thereof and across said rectangular closed-loop element;

a signal feeding line having one end connected to a top portion of said layer of rectangular grounding element and the other end connected to a bottom portion of said vertical rectangular protrusion portion; and a layer of copper foil plated on said back surface side of said dielectric substrate and covering a left/right half portion of said front surface side of said dielectric substrate for generating phase differences between currents from two half portions of said rectangular closed-loop element.

2. The antenna as claimed in claim 1, wherein said phase differences generated by said layer of copper foil enhance radiation effects.

3. The antenna as claimed in claim 1, wherein said rectangular grounding element adjusts the impedance matching between said rectangular closed-loop element and said signal feeding line by controlling the distance between said rectangular closed-loop element and said layer of rectangular grounding element.

4. The antenna as claimed in claim 1, wherein the size of said rectangular closed-loop element is about 7.2 mm by 42.3 mm.

5. The antenna as claimed in claim 1, wherein the size of said layer of rectangular grounding element is about 2.4 mm by 36 mm.

6. The antenna as claimed in claim 1, wherein said layer of rectangular grounding element is made of copper foil.

7. The antenna as claimed in claim 1, wherein said signal feeding line is made of copper foil.

* * * * *